United States Patent [19]

Stanfield

[11] 4,064,638

[45] Dec. 27, 1977

[54] APPARATUS FOR DRYING SEEDS

[75] Inventor: Zenas Allen Stanfield, Bloomington, Ill.

[73] Assignee: Ciba-Geigy AG, Basel, Switzerland

[21] Appl. No.: 701,734

[22] Filed: June 30, 1976

[51] Int. Cl.[2] ..... F26B 17/12

[52] U.S. Cl. ..... 34/174; 34/218; 34/164; 34/175

[58] Field of Search ..... 34/64, 65, 102, 168, 34/169, 174, 218, 219, 175, 164; 98/55

[56] References Cited

U.S. PATENT DOCUMENTS

| | | | |
|---|---|---|---|
| 3,538,618 | 11/1970 | Neuenschwander | 34/102 |
| 3,563,399 | 2/1971 | Shivers | 34/102 |
| 3,634,949 | 1/1972 | Louks | 34/174 |
| 3,727,556 | 4/1973 | Adams | 34/102 |

FOREIGN PATENT DOCUMENTS

| | | | |
|---|---|---|---|
| 849,830 | 9/1952 | Germany | 34/65 |

*Primary Examiner*—John J. Camby
*Assistant Examiner*—Henry C. Yuen
*Attorney, Agent, or Firm*—Wenderoth, Lind & Ponack

[57] ABSTRACT

An apparatus for drying seed corn on the ear or shelled seed corn or other seed. A cylindrical housing has a roof thereon with an aperture at the center of said roof and closable openings therein, one of which is a discharge opening in the side of said housing. A downwardly directed conical wall fills the entire internal cross-section of the housing and has a plurality of perforations distributed evenly therein and an opening at the bottom thereof. An open sided pan is positioned beneath the bottom opening of the conical wall and is inclined toward the open side, and a vibrator is operatively associated with the pan for vibrating it. A discharge conveyor has one end beneath the open side of the pan and the other end at the discharge opening. A distributing chute in the upper part of the housing above the conical wall has a funnel-shaped receiving portion beneath the opening in the center of the roof and a distributing chute extending from the bottom of the funnel-shaped receiving portion downwardly and outwardly from the center of the housing to adjacent the periphery of the housing. A distributing chute rotating means such as a motor-driven wheel on a track rotates the distributing chute with the funnel-shaped receiving portion beneath the opening in said roof and the end of the distributing chute moving around the periphery of the housing. A gaseous drying medium inlet pipe opens into the housing below said conical wall and has a gaseous medium pumping means therein and a heater and a damper downstream of the pumping means, and a reverse flow pipe extends from the inlet pipe between the heater and the damper and through the roof into the space above the conical wall and has a further damper therein. Other pipes and dampers allow for recirculation of air through the fan and heater, whether feeding air up or down.

The ear corn, after drying, is removed from the conical perforated floor through the opening at the bottom by means of the vibrator which vibrates the corn but does not vibrate the perforated wall.

5 Claims, 3 Drawing Figures

APPARATUS FOR DRYING SEEDS

This invention relates to a seed grain dryer, and more particularly relates to a dryer for drying seed grain, and especially ear corn, which is to be shelled to obtain seed corn.

BACKGROUND OF THE INVENTION AND PRIOR ART

Two well-known methods of drying granular material such as grain are the bin layer dryer method and the batch-in-bin type method. The former method utilizes a dryer with a fan and a heat unit which dries the granular material by forcing heated air through a perforated bottom floor of a bin and then upwardly through successive layers of the granular material added to the bin, thereby absorbing moisture and thus reducing the moisture content in the material. Since the heated air is forced into the bin from beneath the first layer, it is obvious that the lower levels in the bin are subjected to several repetitions of the flow of the drying air. Moreover, a bin layer dryer system requires a substantial amount of time to dry a full bin of granular material, and there is always the danger of overheating or overdrying the material in the lower layers.

The batch-in-bin dryer system is an improvement on the bin layer dryer method, and in this method, a single layer is dried on the perforated floor of the dryer bin, and then transferred to a storage bin. This overcomes the disadvantages of the bin layer dryer method in that each layer is subjected to drying only once. However, one of the disadvantages of this system is that an entire batch must be dried before any of it can be removed for replacement by a new batch.

More recently efforts have been made to provide continuous-flow dryers for granular material, one such apparatus being disclosed in U.S. Pat. No. 3,634,949 to Robert A. Louks. In this apparatus, a cylindrical housing is provided with a downwardly directed cone having a perforated wall portion at the lower part thereof, and a second smaller perforated cone is positioned within the first cone near the bottom thereof to define an annular conical space therebetween. Grain is fed into this space, and as it moves down the space to the bottom of the outer cone, warm air is forced across the annular conical space through the perforated wall portions to dry the grain moving along the cones.

While this apparatus is readily adaptable for drying such grains as feed corn, it does not permit the precise control required for the drying of seed grain, and particularly seed corn.

It has become increasingly recognized among those skilled in the art of handling seed grain that grain for use as seed must be handled much more carefully than grain which is to be used simply for feed or other food purposes. In particular, it has been found that the quality of the grain, particularly with respect to the percentage of the grain which germinates and the ability of the grain to withstand storage, depends to a large extent on the moisture content and the particular manner in which the seed has been dried.

This is particularly important for seed grain such as seed corn which must be removed from the ear, i.e. shelled, after it has been dried so as to be packaged for distribution for use as seed.

Applicant has found that in order to obtain seed corn with the best characteristics for germination and storage, and ear corn, i.e. the corn in the form of ears with the kernals still on the ears, should be dried to a moisture content of from about 12 to about 13% by weight. It has been found that when the ear corn has this moisture content, it is not only readily shelled, but the seed corn thus obtained has outstanding characteristics with respect to germination and ability to withstand storage.

It would be of great benefit to the art of handling seed grain, and particularly, seed corn, if an apparatus could be provided which would dry ear corn to a range of moisture content which would result in good properties of the seed corn shelled from the ear.

OBJECTS AND BRIEF SUMMARY OF THE INVENTION

It is an object of the present invention to provide a type dryer for seed grain in which the moisture content of the grain can be precisely controlled.

It is a further object of the present invention to provide such a dryer in which the moisture content can be controlled and yet which is economical in the use of energy for carrying out the drying operation.

It is a still further object of the invention to provide a dryer of the type described which can handle ear corn which is to be used for the production of seed corn.

These objects are achieved by the dryer apparatus according to the present invention comprising:

a cylindrical housing having a roof thereon with an aperture at the center of said roof, said housing having closable openings therein, one of which is a discharge opening in the side of said housing;

a downwardly directed conical wall filling the entire internal cross-section of said housing and having a plurality of perforations distributed evenly therein and having an opening at the bottom thereof;

an open-sided pan beneath said bottom opening of said conical wall and inclined toward said open side;

a vibrator operatively associated with said pan for vibrating said pan in a direction parallel to the bottom of said pan;

a discharge conveyor in said housing having one end beneath the open side of said pan and the other end at said discharge opening;

a distributing chute in the upper part of said housing above said conical wall and having a funnel-shaped receiving portion beneath the opening in said roof and a distributing pipe extending from the bottom of said funnel-shaped receiving portion downwardly and outwardly from the center of said housing to adjacent the periphery of said housing;

a distributing chute rotating means coupled to said distributing chute for rotating said distributing chute with said funnel-shaped receiving portion beneath said opening in said roof and the end of the distributing pipe moving around the periphery of said housing;

a cylindrical baffle within said housing above said conical wall with the lower edge of said baffle spaced upwardly from said conical wall for helping maintain a stable bed of material to be dried on said conical wall;

a gaseous drying medium inlet pipe opening into said housing below said conical wall and having a gaseous medium pumping means therein and a heater upstream or downstream and a damper downstream of said pumping means; and a reverse flow pipe extending from said inlet pipe between said heater and said damper and through said roof into the space above said conical wall and having a further damping therein;

a means for re-circulating the drying medium to effect thermal efficiency improvement.

BRIEF DESCRIPTION OF THE FIGURES

These and other objects will become apparent from the following specification, taken together with the accompanying drawings, in which.

DETAILED DESCRIPTION OF THE INVENTION

The dryer of the present invention is a dryer which handles successive batches of material substantially automatically, i.e. the amount of material to be dried is caused to flow in a stream into the dryer, the amount of material is held in the apparatus for the drying operation, then the dried material is caused to flow in a stream out of the dryer, and then the next amount of material is caused to flow in a stream into the dryer, etc.

Figure 1:
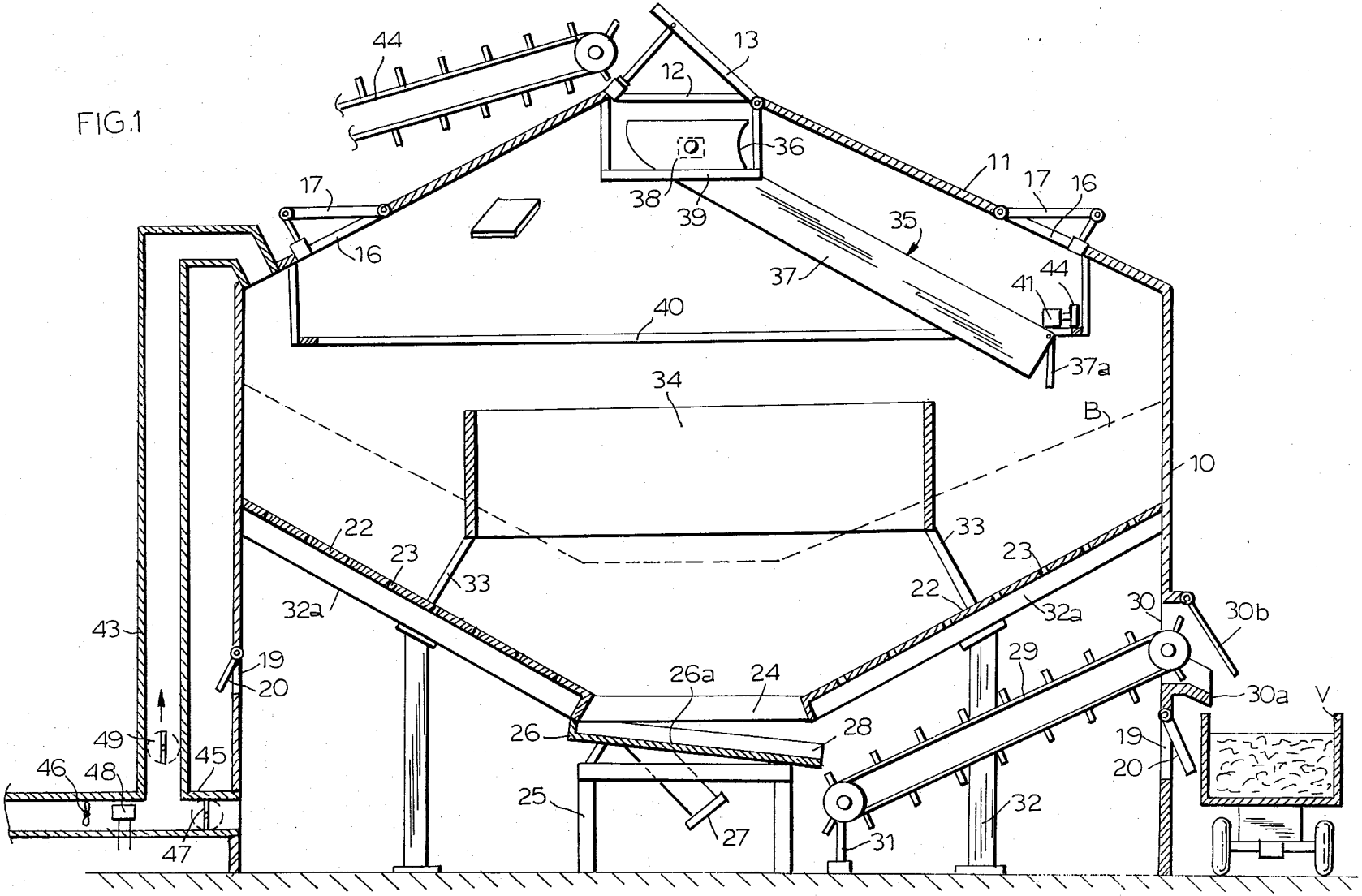
FIG. 1 is a sectional elevational view of a seed grain dryer according to the present invention.

The embodiment of the dryer for granular material according to the present invention as shown in FIG. 1 has a housing defined by a generally cylindrical outer wall 10 and an upwardly pointed conical roof 11 having an opening 12 at the top center thereof. A hatch cover 13 over the opening 12 is located so as to be movable from a position as shown in FIG. 1, in which the opening 12 is open, to a position in which the opening 12 is closed.

Hatches 16 are provided at points spaced around the roof 11 and are opened and closed by hatch covers 17. Similar hatches 19 are provided in the cylindrical wall 10 and are closed by hatch covers 20 which can be braced in the open position. It is clear that automatic remote control hatch cover actuating means can be provided for each hatch cover or operated manually or remotely by ropes, wires or other means.

Within the lower portion of the housing is a downwardly inclined perforated conical wall 22 having a large number of evenly distributed perforations 23 therein, and having a downwardly directed opening 24 at the botton thereof. The conical wall 22 is supported at points spaced inwardly from the cylindrical wall 10 by posts 32 and beams 32A placed at intervals around the interior of the housing.

Beneath the opening 24 is a support frame 25 which supports a three-sided pan 26 inclined in the direction of the open end 28 thereof. Attached to the bottom of the pan 26 is a conventional vibrator device 27 driven by a power source (not shown) for vibrating only the pan 26 generally in a direction parallel to the bottom **26*a* thereof. The vibrator device 27 does not vibrate the wall 22**.

A discharge conveyor 29 extends from beneath the open end 28 of the pan 26 upwardly and toward the cylindrical wall 10 to a discharge opening 30. The lower end of the conveyor 29 is mounted on a stand indicated generally at 31, while the upper end can be attached to a cylindrical wall 10 adjacent the opening 30. A discharge chute **30*a* extends outwardly from the outer surface of the wall 10 beneath discharge opening 30, and a hatch cover 30*b* closes the opening 30 when the conveyor 29** is not operating.

A baffle member can be provided within the housing desired. The baffle is mounted above the conical wall 22 within the housing on supports 33 from the conical wall 22. The baffle is a cylindrical or ring-shaped baffle 34 which extends downwardly toward the conical wall 22 and has the lower edge thereof spaced from the conical wall 22.

A distributing chute 35 is rotatably mounted just beneath the roof 11, and consists of an upwardly opening funnel-shaped receiving portion 36 and a tubular distributing pipe 37 extending from the bottom of the funnel-shaped receiving portion 36 downwardly and laterally toward the cylindrical wall 10, stopping at a point spaced slightly from the cylindrical wall 10. A pivoted gate **37*a* on the end of pipe 37 and which may be of rubber, prevents the corn from hitting the wall 10 and makes the corn drop straight down or nearly so. The funnel-shaped receiving portion is pivotally mounted on bearings 38 supported on a ring 39 for turning 360°. A track 40 around the periphery of the bin 10 supported from top 11 supports wheels 44 and a motor driven device 41 which turns chute 37 around the bin 360° and for supporting the distributing chute 37** in the position shown.

A feed conveyor 44 can be provided above the roof 11 for supplying the material to be dried to the top opening 12 in the roof 11.

A gaseous drying medium inlet pipe 45 opens into the lower part of the housing through cylindrical wall 10. Positioned in the pipe 45 is gaseous medium pumping means is the form of a blower, generally indicated at 46, and a damper 47 between the blower and the cylindrical wall 10. A heater 48 is provided in the pipe 45 upstream or downstream of the blower 46, the heater in the present embodiment being shown as a natural gas heater. Other types of heaters, of course, may be employed.

A reverse flow pipe extends from the pipe 45 between the blower 46 and the damper 47 upwardly and through the roof 11 of the apparatus, and a second damper 49 is provided in the pipe 43.

The operation of the apparatus will now be described with reference to drying ear corn which is eventually to be shelled to obtain seed corn. In this operation, a batch of ear corn is fed by means of conveyor 44 into the apparatus through the opening 12. It is received by the distributing chute 35 and directed to the peripheral portion of the interior of the apparatus. The distributing chute 35 is rotated around the central vertical axis of the apparatus by the device 41 on track 40 so as to distribute the ear corn being supplied to the apparatus evenly around the periphery of the interior of the apparatus. The ear corn first falls on the perforated cone and slides down the conical wall 22 and is stopped at the bottom opening 24 by the pan 26. As more corn is supplied, the corn builds up on the conical wall.

When sufficient ear corn has been supplied to form the bed B, shown in phantom lines, on the conical wall 22, the feed is discontinued.

The baffle 34 usually is not required but may be added to assist in the formation and maintenance of a uniform depth of bed on the conical wall 22. Moreover, the angle $\alpha$ of the conical wall 22 with respect to the horizontal is between the angle of repose of the material being dried, about 35°–45° for ear corn, and the angle at which the granular material will slide down the conical wall under the effect of gravity, in the case of ear corn about 19°-22°. A typical device has an angle of 25° from horizontal.

After the completion of the supply of the batch of ear corn is completed, the hatch cover 17, the hatch covers 20 and the hatch cover **30*b* are closed. Thereafter, with the damper 47 open and the damper 49 closed, a gaseous drying medium, e.g. air, is blown through the inlet pipe 45 by the blower 46 over the heater 48 into the interior of the apparatus where it is distributed substantially uniformly in the space below the conical wall 22. It then is forced through the apertures 23 and through the bed B of ear corn lying on the conical wall 22. The heated air thus serves to dry the corn in the bed B. The air then is permitted to escape through the hatches 16**, which are left open.

After a predetermined time, or moisture content, as will be discussed below, the dampers 47 and 49 are reversed, the damper 47 being closed and the damper 49 being opened, and the hatches 16 are closed by closing the covers 17 and the hatches 19 are opened by opening the hatch covers 20. The heated drying medium is thus directed into the space above the bed B where it is evenly distributed and then it flows downwardly through the bed, through the apertures 23 in the conical wall 22, and escapes through the hatches 19.

This reversal of flow of the drying medium may be repeated periodically until the grains of corn on the ears have reached the desired moisture content, although usually one period of flow in the upward direction and one period of flow in the downward direction is sufficient.

It has been found that in an apparatus having a capacity of ear corn which will yield 1500 bushels of said corn, i.e. about 4000 cu. ft. of ear corn in a bed B about 6 ft. thick, and with the drying medium being air heated to a temperature of from 105° to 110° F., the moisture content of the corn on the ears on the top and the bottom of the bed can be brought to 12%, and the moisture content of the corn on the ears at the middle of the bed can be brought to from 12 ½ to 13%. The volume of air pumped is about 20 cu. ft./min. per bushel of seed corn shelled from the bin, or about 30,000 ct. ft./min. The time for drying is from about 48 hours to about 72 hours, depending on the initial moisture content of the corn.

After drying to the desired moisture content, the vibrator 27 is actuated for vibrating the pan 26 for continuously feeding dried ears of corn through the open bottom end 28 of the pan onto the discharge conveyor 29, by which the ears with the dried corn thereon are conveyed out through the discharge opening 30 and into a means for conveying the ears of corn to a shelling apparatus, for example, a vehicle V or a conveyor. The vibrator can be a commercially available device vibrating at a frequency of 60 cycles/sec. with a displacement of approximately 0.055 to 0.06 inches, and which can move about 50 tons/hr. along the pan onto the conveyor 29.

After the apparatus is empty, a new batch of ear corn is fed in and the drying cycle is repeated.

In the embodiment of FIG. 1, it will be noted that the gaseous drying medium, after it has picked up the moisture from the bed B, is discharged through either the hatches 16 or the hatches 19, depending upon the direction of the flow of the drying medium through the bed. Where the temperature of drying medium after it has passed through the bed B is higher than the temperature of the drying medium as it first enters the inlet pipe 45, this will result in some waste of the heat initially used to heat up the drying medium.

Figure 2:
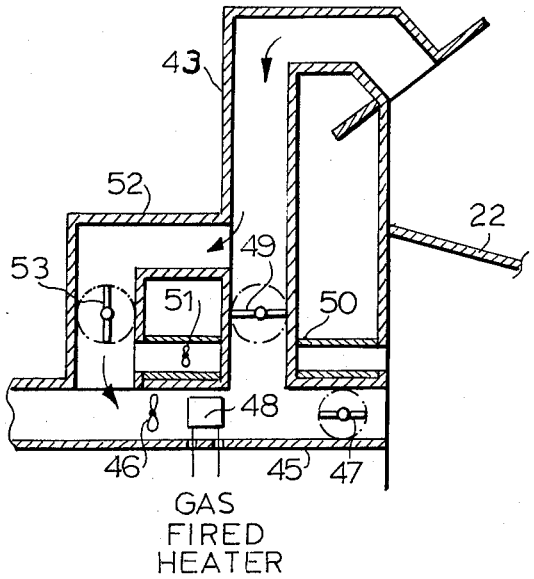
FIG. 2 is a partial sectional view showing a modified form of a portion of the apparatus of FIG. 1.

In order to avoid this waste of heat and thereby conserve the energy used in carrying out the drying process, the modification of the apparatus of FIG. 1 which is shown in FIG. 2 can be employed. This modification adds two return bypass pipes to the arrangement as shown in FIG. 1.

As seen in FIG. 2, a return bypass pipe 50 is in communication with the space within the housing 10 below the conical wall 22, extending directly from the space below the conical wall 22 parallel with the pipe 45 and into the pipe 45 upstream of the blower 46. This bypass return pipe 50 has a damper 51 therein.

A second return bypass pipe 52 is in communication with the space within the housing above the conical wall 22 through the end of reverse flow pipe 43, extending from the reverse flow pipe 43 back to the pipe 45 upstream of the blower 46, and this pipe likewise has a damper 53 therein.

When the gaseous drying medium is being pumped through the bed B in the upward direction, the dampers in the piping arrangement of FIG. 2 are set as shown, i.e. with the damper 47 open to permit the gaseous drying medium to be pumped into the lower part of the housing 10, and the damper 49 closed so as to block reverse flow of the drying medium. The damper 51 is likewise closed to prevent return of the drying medium pumped into the housing to the feed pipe 45. The damper 53, however, is at least partially open, and the hatches in the apparatus are at least partially closed, thereby creating a partially closed circulatory system. The heated gaseous drying medium flowing into the apparatus flows upwardly through the bed B, and at least part of the medium flows through the reverse flow pipe 43, through the bypass pipe 52 past the damper 53, and is again blown by the blower 46 over the heater 48 and into the lower part of the apparatus.

For reverse flow, the positions of the various dampers are simply reversed from the positions as shown in FIG. 2, whereby a circulatory system with the gaseous drying medium flowing in the opposite direction is established.

Figure 3:
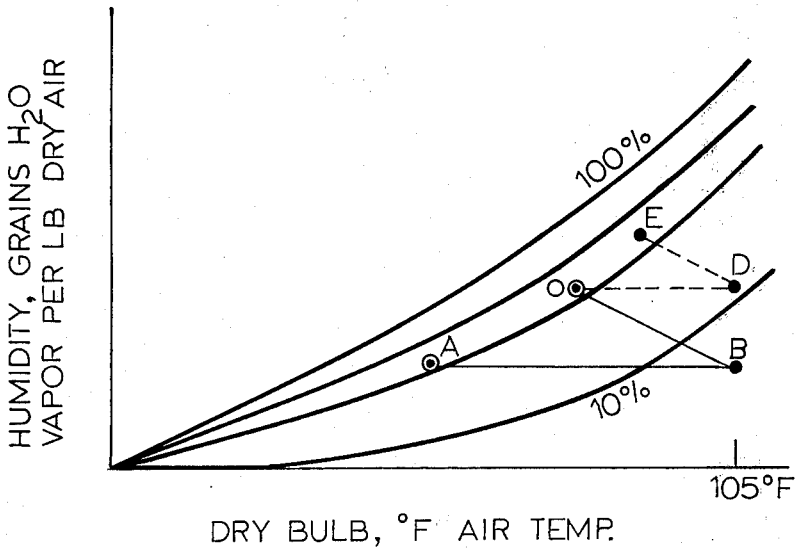
FIG. 3 is a graph showing the manner in which a gaseous drying medium is heated during the flow through the apparatus according to the present invention.

As seen from FIG. 3, which is for air as the gaseous drying medium, ambient air at condition A is heated as it passes over the heater 48 to the temperature B, which in the preferred manner of operating the apparatus is about 105°-110° F. As it flows through the ear corn, it picks up moisture, while the temperature thereof falls, and it reaches the condition C in which it may have a relative moisture content above that desired for drying the final seed corn.

Where the temperature at point C is above the ambient air temperature, it is recirculated, and it is again passed over the heater 48, and it is changed to the condition D in which the temperature is increased, and the relative moisture content is reduced again. It then again passes through the bed B, in which the moisture content is increased and the temperature again falls.

It will be seen that the air can be recirculated a number of times, and in practice, even with damper 53 fully open, sufficient air escapes from the apparatus so that ambient air is constantly being added. This amount can be controlled by controlling the positions of dampers 51 and 53. The amount of heat which must be added to the air actually entering the housing is reduced by the difference between the amount of heat necessary to reheat the recycled drying medium and the amount necessary to heat the same amount of incoming medium to the same temperature.

While the foregoing description has been directed particularly to drying of ear corn for use as seen corn, it will be appreciated that the apparatus can be used for drying of other types of grain for use as seed, and for other types of seed where close control of moisture content is necessary. The batches of material to be dried are fed batch by batch through the apparatus is a continual flow. The material is handled by the apparatus itself, substantially eliminating manual labor. The control of moisture content of the dried material can be very close, the variation in moisture content across the thickness of the bed being very small. By recycling the drying medium, the apparatus can be operated economically.

What is claimed is:

1. An apparatus for continually drying a granular material comprising:

a cylindrical housing having a roof thereon with an aperture at the center of said roof, said housing having closable openings therein, one of which is a discharge opening in the side of said housing;

a downwardly directed conical wall filling the entire internal cross-section of said housing and having a plurality of perforations distributed evenly therein and having an opening at the bottom thereof;

an open sided pan beneath said bottom opening of said conical wall and inclined toward said open side;

a vibrator operatively associated with said pan for vibrating said pan in a direction parallel to the bottom of said pan;

a discharge conveyor in said housing having one end beneath the open side of said pan and the other end at said discharge opening;

a distributing chute in the upper part of said housing above said conical wall and having a funnel-shaped receiving portion beneath the opening in said roof and a distributing pipe extending from the bottom of said funnel-shaped receiving portion downwardly and outwardly from the center of said housing to adjacent the interior periphery of said housing;

a distributing chute rotating means coupled to said distributing chute for rotating said distributing chute with said funnel-shaped receiving portion beneath said opening in said roof and the end of the distributing pipe moving around the periphery of said housing;

a gaseous drying medium inlet pipe opening into said housing below said conical wall and having a gaseous medium pumping means therein and a heater and a damper downstream of said pumping means; and a reverse flow pipe extending from said inlet pipe between said heater and said damper and through said roof into the space above said conical wall and having a further damper therein.

2. An apparatus as claimed in claim 1 further comprising a cylindrical baffle within said housing above said conical wall with the lower edge of said baffle spaced upwardly from said conical wall for helping maintain a stable bed of material to be dried on said conical wall.

3. An apparatus as claimed in claim 1 in which the angle of said conical wall with respect to the horizontal is between the angle of repose of the material to be dried and the angle at which the material will slide down the conical wall under the effect of gravity.

4. An apparatus as claimed in claim 3 which is for drying ear corn for producing seed corn therefrom and in which the upper limit of said angle is about from 35°–45° and the lower limit of said angle is from about 19°–22°.

5. An apparatus as claimed in claim 1 further comprising a first return bypass pipe communicating with the space within said housing below said conical wall and extending to said inlet pipe upstream of said pumping means and having a damper therein, and a second bypass return pipe is communication with the space within said housing above said conical wall and extending to said inlet pipe upstream of said pumping means and having a damper therein.

* * * * *

UNITED STATES PATENT AND TRADEMARK OFFICE

CERTIFICATE OF CORRECTION

PATENT NO. : 4,064,638

DATED : December 27, 1977

INVENTOR(S) : Zenas Allen Stanfield

It is certified that error appears in the above-identified patent and that said Letters Patent are hereby corrected as shown below:

Cover page, [73] delete "Assignee: CIBA-GEIGY AG, Basle, Switzerland"

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*